US010095168B2

(12) United States Patent
Suzuki

(10) Patent No.: US 10,095,168 B2
(45) Date of Patent: Oct. 9, 2018

(54) FIXING DEVICE WITH DECREASE IN SLIDING RESISTANCE OF ENDLESS BELT AND FRICTIONAL WEARING THEREOF

(71) Applicant: BROTHER KOGYO KABUSHIKI KAISHA, Nagoya-shi, Aichi-ken (JP)

(72) Inventor: Kaoru Suzuki, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 27 days.

(21) Appl. No.: 15/404,952

(22) Filed: Jan. 12, 2017

(65) Prior Publication Data

US 2017/0205746 A1 Jul. 20, 2017

(30) Foreign Application Priority Data

Jan. 15, 2016 (JP) ..... 2016-005973

(51) Int. Cl.
*G03G 15/00* (2006.01)
*G03G 15/20* (2006.01)

(52) U.S. Cl.
CPC . *G03G 15/2085* (2013.01); *G03G 2215/2035* (2013.01)

(58) Field of Classification Search
CPC ..... G03G 15/2053; G03G 15/2025; G03G 15/2064; G03G 15/2028; G03G 2215/2035
See application file for complete search history.

(56) References Cited

U.S. PATENT DOCUMENTS 8,995,894 B2 * 3/2015 Jeong ..... G03G 15/2039 399/329
2005/0008412 A1 * 1/2005 Aruga ..... G03G 15/2064 399/329
2013/0058690 A1 * 3/2013 Arimoto ..... G03G 15/2053 399/329

FOREIGN PATENT DOCUMENTS

JP 2008-185661 A 8/2008
JP 2009-109635 A 5/2009
JP 2010-281887 A 12/2010
JP 2013-186192 A 9/2013

* cited by examiner

*Primary Examiner* — Walter L Lindsay, Jr.
*Assistant Examiner* — Jessica L Eley
(74) *Attorney, Agent, or Firm* — Merchant & Gould P.C.

(57) ABSTRACT

A fixing device for thermally fixing a toner image on a sheet includes a heat unit, a pressure unit, and a nip member. One of the heat unit and the pressure unit includes an endless belt having a width in a widthwise direction and a restriction member configured to be abutted against the endless belt. The endless belt includes a base layer having an outer peripheral surface and a pair of widthwise end faces in the widthwise direction, the base layer defining an inner space, and an elastic layer formed on the outer peripheral surface and having a thickness and a pair of widthwise end surfaces in the widthwise direction. One of the end faces and a corresponding one of the end surfaces provides a maximum distance therebetween in the widthwise direction smaller than the thickness of the elastic layer.

19 Claims, 7 Drawing Sheets

FIXING DEVICE WITH DECREASE IN SLIDING RESISTANCE OF ENDLESS BELT AND FRICTIONAL WEARING THEREOF

CROSS REFERENCE TO RELATED APPLICATION

This application claims priority from Japanese Patent Application No. 2016-005973 filed Jan. 15, 2016. The entire content of the priority application is incorporated herein by reference.

TECHNICAL FIELD

The present disclosure relates to a fixing device including a heat unit and a pressure unit for thermally fixing a developing agent image on a sheet passing through and between the heat unit and the pressure unit. The present disclosure also relates to an image forming apparatus provided with the fixing device.

BACKGROUND

A conventional fixing device is provided with an endless belt including a base layer made from resin or metal and an elastic layer made from rubber formed over an outer surface of the base layer. The fixing device is also provided with a restriction member positioned outward of widthwise end surfaces of the endless belt. The widthwise end surfaces are positioned at ends of the belt in a widthwise direction perpendicular to a circumferential direction of the belt. The widthwise end surfaces may be slidingly contacted with the restriction member in a circular movement of the endless belt. Therefore, widthwise end surfaces of the elastic layer are also in sliding contact with the restriction member, which causes resistance against circular movement of the endless belt, and may cause frictional wearing of the elastic layer.

Japanese Patent Application Publication No. 2008-185661 discloses a fixing device provided with a lubricant retaining portion. The retaining portion is provided at each widthwise end surface of the endless belt. Lubricant retained in the lubricant retaining portion can lower sliding resistance between the widthwise end surfaces of the endless belt and the restriction member.

SUMMARY

The lubricant retaining portion described in the above Japanese Publication is made from a porous member attached to each widthwise end portion of the endless belt. Alternatively, a groove forming member is attached to each widthwise end portion of the endless belt to provide the lubricant retaining portion. Therefore, resultant endless belt has a complicated structure.

It is therefore an object of the disclosure to provide a fixing device capable of restraining increase in sliding resistance imparted on the endless belt and restraining frictional wearing of the elastic layer.

Another object of the disclosure is to provide an image forming apparatus provide with such an improved fixing device.

In order to attain the above and other objects, one aspect provides a fixing device including a heat unit and a pressure unit, a toner image on a sheet being thermally fixed between the heat unit and the pressure unit. At least one of the heat unit and the pressure unit includes an endless belt having a width in a widthwise direction and extending in a circumferential direction perpendicular to the widthwise direction. The endless belt includes a base layer having an outer peripheral surface and a pair of widthwise end faces in the widthwise direction, the base layer defining an inner space; and an elastic layer formed on the outer peripheral surface and having a thickness and a pair of widthwise end surfaces in the widthwise direction, one of the end faces and a corresponding one of the end surfaces providing a maximum distance therebetween in the widthwise direction smaller than the thickness. The fixing device further includes a nip member provided in the inner space and configured to nip the endless belt in cooperation with a remaining one of the heat unit and the pressure unit; the one of the widthwise end surfaces having a portion positioned inside of the corresponding one of the end faces in the widthwise direction; and a restriction member positioned outside of each of the widthwise end faces in the widthwise direction, the restriction member being configured to be abutted against the widthwise end face.

According to another aspect, a fixing device has a first unit and a second unit, a toner image on a sheet being fixed between the first unit and the second unit. The first unit includes an endless belt having a width in a widthwise direction and extending in a predetermined direction perpendicular to the widthwise direction. The endless belt includes a first layer having a first thickness, a first end face in the widthwise direction, and an upper surface; and a second layer positioned on the upper surface of the first layer and having a second thickness and a second end face in the widthwise direction. The fixing device further includes a nip member disposed inside a loop of the endless belt and configured to nip the endless belt in cooperation with the first unit and the second unit; and a side wall positioned outside of the second end face in the widthwise direction and extending so as to face the first end face and the second end face. A maximum distance between the first end face and the second end face in the widthwise direction is smaller than the second thickness.

BRIEF DESCRIPTION OF THE DRAWINGS

The particular features and advantages of the disclosure will become apparent from the following description taken in connection with the accompanying drawings, in which.

DETAILED DESCRIPTION

An image forming apparatus according to one embodiment will be described with reference to FIGS. 1 through 5.

Figure 1:
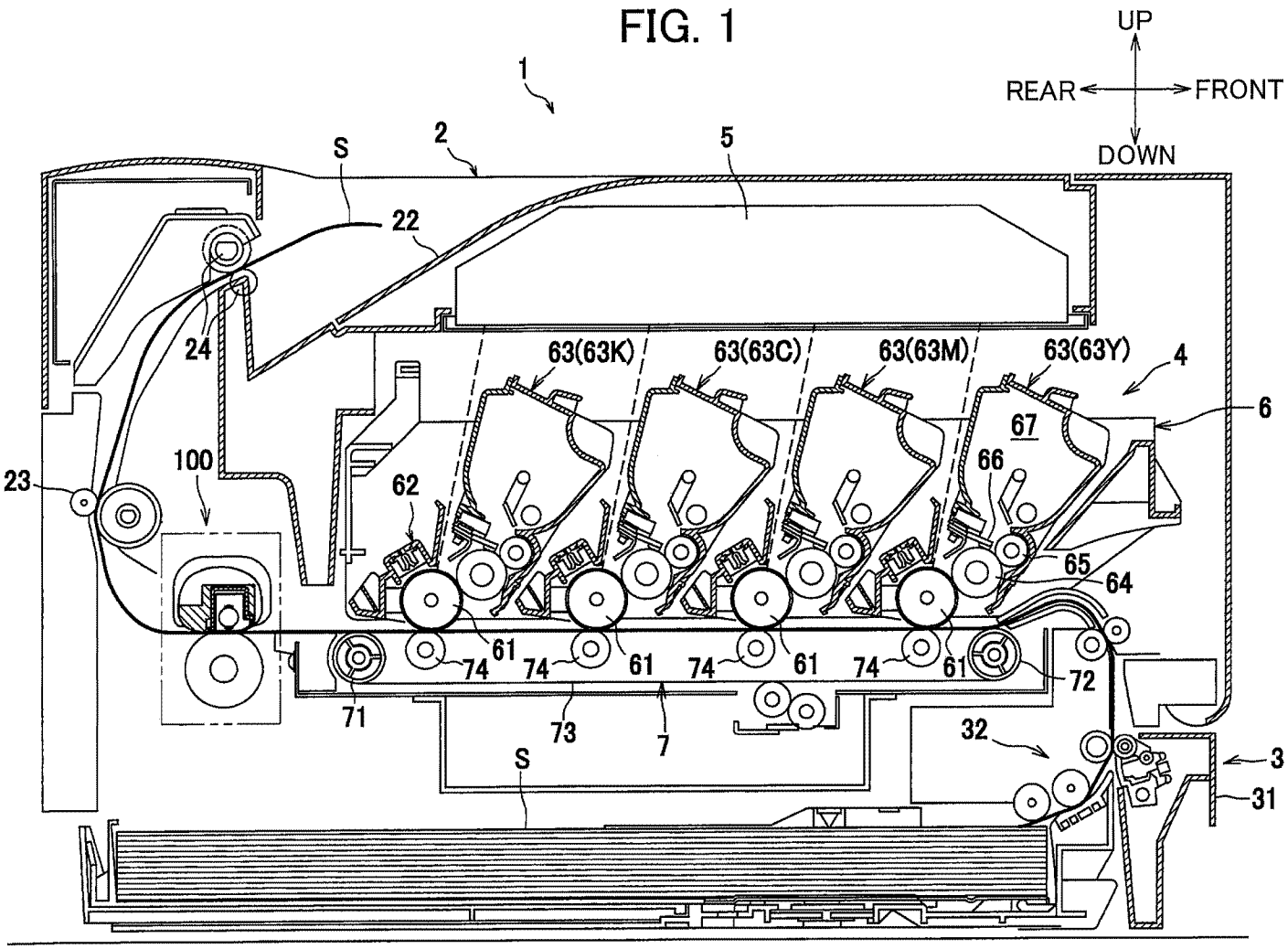
FIG. 1 is a cross-sectional view of an image forming apparatus according to one embodiment

As the image forming apparatus, a color laser printer 1 is illustrated in FIG. 1. The terms "upward", "downward", "upper", "lower", "above", "below", "beneath", "right", "left", "front", "rear" and the like will be used throughout the description assuming that the laser printer 1 is disposed in an orientation in which it is intended to be used as illustrated in FIG. 1. In FIG. 1, right side and left side are front side and rear side, respectively, a near side and far side in FIG. 1 are left side and right side, respectively, and upper side and lower side in FIG. 1 are upper side and lower side, respectively.

As illustrated in FIG. 1, the color laser printer 1 includes a housing 2, a sheet supply unit 3, and an image forming unit 4. The sheet supply unit 3 is provided at a lower portion of an inside of the housing 2, and includes a sheet supply tray 31 and a sheet supply mechanism 32. In the sheet supply unit 3, each one of sheets S accommodated in the sheet supply tray 13 is separated from remaining sheets and is supplied to the image forming unit 4.

The image forming unit 4 includes an exposure unit 5, a process unit 6 including a photosensitive drum 61, a transfer unit 7, and a fixing device 100.

The exposure unit 5 is positioned at an upper portion of the inside of the housing 2, and includes a light source, a polygon mirror, a plurality of lenses, and a plurality of reflection mirrors those not illustrated. The exposure unit 5 is adapted to scanningly irradiate a light beam as indicated by broken lines in FIG. 1 based on image data to a surface of the photosensitive drum 61 to expose the surface of the photosensitive drum 61 to light.

The process unit 6 is positioned between the sheet supply tray 31 and the exposure unit 5. The process unit 6 includes four photosensitive drums 61 arrayed in a frontward/rearward direction, four chargers 62, and four developing cartridges 63. Each charger 62 and each developing cartridge 63 are provided for each photosensitive drum 61. Each developing cartridge 63 includes a developing roller 64, a supply roller 65, a layer thickness regulation blade 66, and a tonner accommodating portion 67 for accommodating toner as an example of developing agent. Each developing cartridge 63 is attachable to and detachable from the housing 2.

The four developing cartridges 63 include a developing cartridge 63Y for the color of yellow, a developing cartridge 63M for the color of magenta, a developing cartridge 63C for the color of cyan, and a developing cartridge 63K for the color of black. These cartridges are arrayed in this order such that the yellow cartridge 63Y is positioned frontward, and the black cartridge 63K is positioned rearward, so that a color image can be formed on the sheet S.

The transfer unit 7 is positioned between the sheet supply tray 31 and the process unit 6 and includes a drive roller 71, a follower roller 72, a conveyer belt 73 and a plurality of transfer rollers 74. The conveyer belt 73 is an endless belt mounted over the drive roller 71 and the follower roller 72 under tension, and is in confrontation with the photosensitive drums 61. Each transfer roller 74 is provided for each photosensitive drum 61 so as to nip the conveyer belt 73 between each transfer roller 74 and each photosensitive drum 61.

The fixing device 100 is positioned rearward of the process unit 6. Details of the fixing device 100 will be described later. A conveyer roller 23 and discharge rollers 24 are provided at a downstream side of the fixing device 100 in a sheet conveying direction. Further, a discharge tray 22 is provided at an upper portion of the housing 2.

In the image forming unit 4, the surface of the photosensitive drum 61 is uniformly charged by the charger 62, and the surface is exposed to the light beam from the exposure unit 5 to form an electrostatic latent image on the surface. Then, the toner is supplied from the developing cartridge 63 to the electrostatic latent image to form a visible toner image on the surface of the photosensitive drum 61.

Then, the sheet S supplied from the sheet supply unit 3 is conveyed to a portion between the photosensitive drum 61 and the transfer roller 74 to transfer the toner image from the surface of the photosensitive drum 61 onto the sheet S. Then, the sheet on which the toner image has been transferred is conveyed to the fixing device 100 to thermally fix the toner image to the sheet S. The sheet S is discharged onto the discharge tray 22 through the conveyer roller 23 and the discharge rollers 24.

Details of the fixing device 100 will next be described. In the depicted embodiment, a leftward/rightward direction corresponds to "a widthwise direction extending perpendicular to a circumferential direction of the endless belt".

Figure 2:
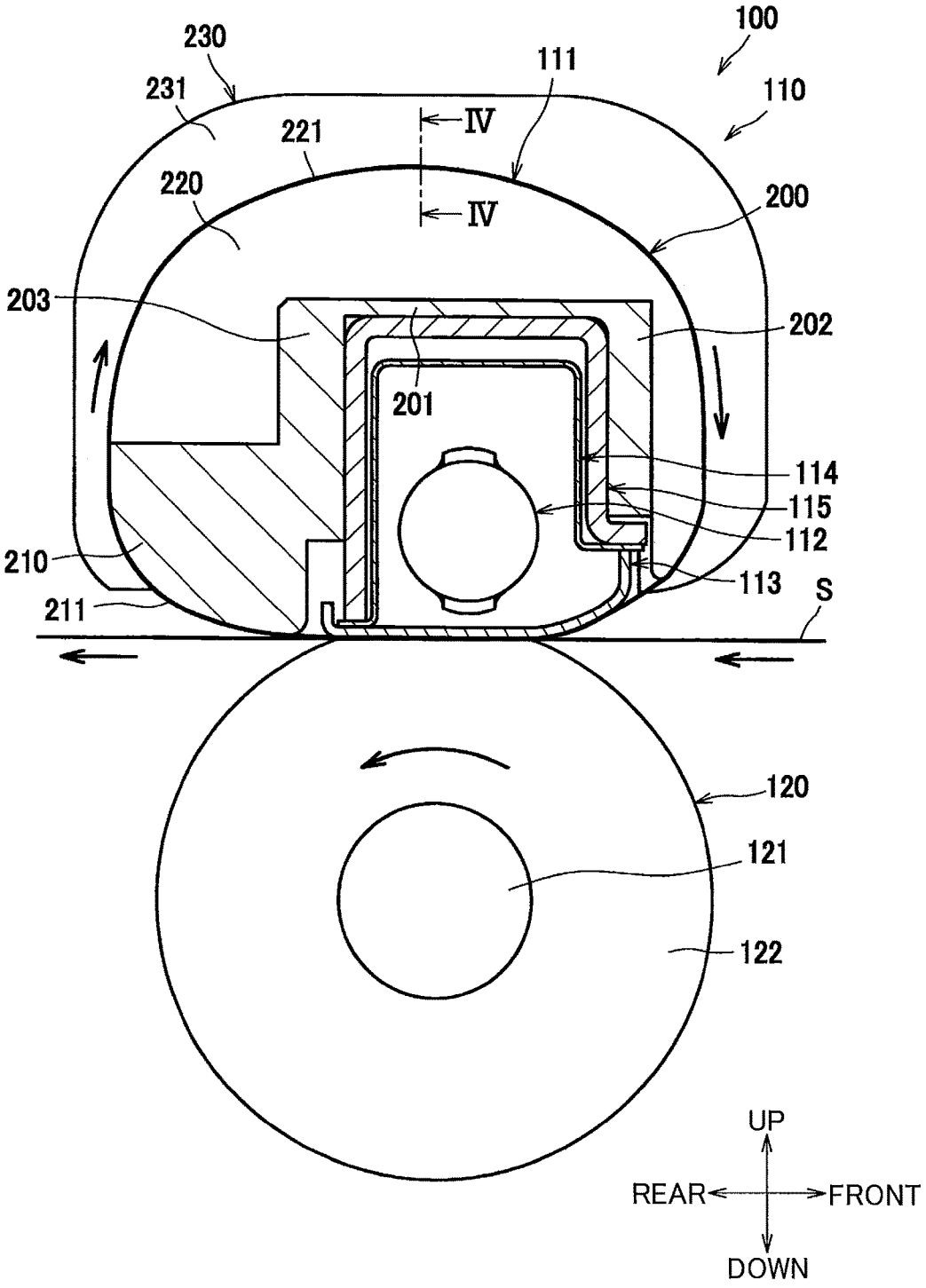
FIG. 2 is a cross-sectional view of a fixing device according to the embodiment.

As illustrated in FIG. 2, the fixing device 100 includes a heat unit 110 and a pressure roller 120 as an example of a pressure unit, and is adapted to thermally fix toner image to the sheet S by conveying the sheet S to a position between the heat unit 110 and the pressure roller 120. The heat unit 110 and the pressure roller 120 are examples of a first unit and a second unit.

The heat unit 110 includes an endless belt 111, a halogen lamp 112 as an example of a heat source, a nip member 113, a reflection member 114, a stay 115, and a cover member 200. The cover member 200 includes a downstream guide portion 210 positioned downstream of the nip member 113, and an inner peripheral guide portion 220.

The endless belt 111 is tubular in shape providing flexibility to make a loop. The endless belt 111 has an inner peripheral surface guided by the downstream guide portion 210 and the inner peripheral guide portion 220, so that circular movement of the endless belt 111 in a predetermined direction, i.e., in a clockwise direction in FIG. 2 can be guided. Details of the endless belt 111 will be described later.

The halogen lamp 112 is positioned at an internal space of the endless belt 111, and is adapted to emit light upon energization for heating the nip member 113 through radiant heat.

The nip member 113 is a plate-like member for receiving radiant heat from the halogen lamp 112. The nip member 113 is positioned in the internal space of the endless belt 111, and is in contact with an inner peripheral surface of the endless belt 111 for nipping the endless belt 111 in cooperation with the pressure roller 120. The nip member 113 is adapted to transmit the radiant heat received from the halogen lamp 112 and to transmit the toner on the sheet S. The nip member 113 is made from metal providing high heat conductivity, such as an aluminum plate.

The reflection plate 114 is adapted to reflect the radiant heat from the halogen lamp 112 toward the nip member 13. The reflection plate 114 is positioned in the internal space of the endless belt 111 for surrounding the halogen lamp 112.

The stay 115 is adapted to support the nip member 113 through the reflection member 114 so as to restrain deformation of the nip member 113 due to the application of load from the pressure roller 120. The stay 115 is positioned to surround the reflection member 114, and is made from metal providing high rigidity. For example, the stay 115 is formed by bending a steel plate.

The cover member 200 is adapted to cover the stay 115 at a position opposite to the halogen lamp 112 with respect to the stay 115. The cover member 200 is elongated in the leftward/rightward direction. The cover member 200 includes an upper side wall 201, a front side wall 202 extending downward from a front end of the upper side wall 201, and a rear side wall 203 extending downward from a rear end of the upper side wall 201. The cover member 200 is made from resin providing heat conductivity lower than that of the materials of the nip member 113 and the stay 115.

Figure 3:
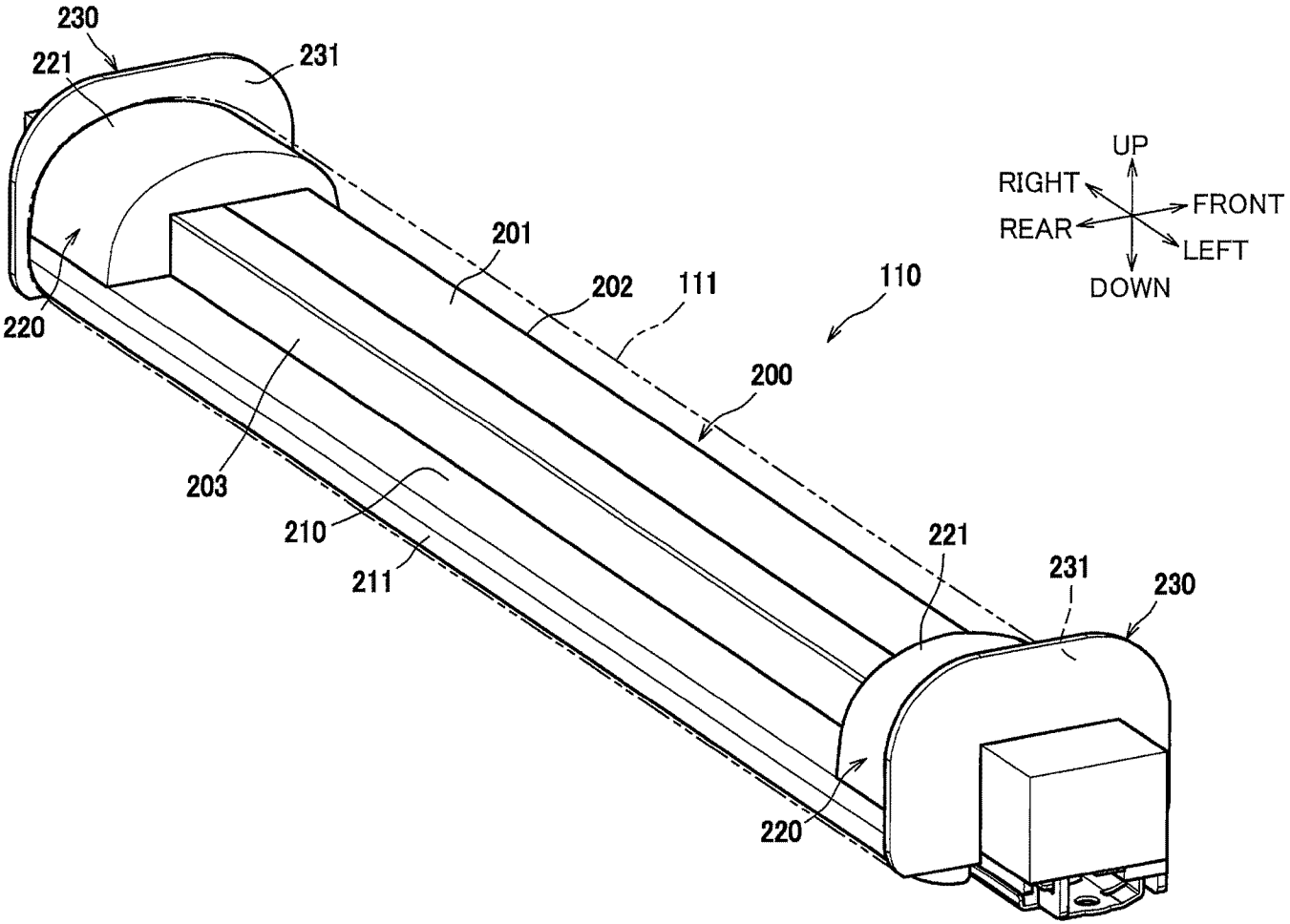
FIG. 3 is a perspective view of a heat unit in the fixing device according to the embodiment.

As illustrated in FIG. 3, the cover member 200 is formed integrally with the downstream guide portion 210, the inner peripheral guide member 220 as examples of guide members, and a restricting portion 230 as an example of a restriction member. The restricting portion 230 is an example of a side wall.

The downstream guide portion 210 is positioned over the area between the widthwise end portions of the endless belt 111 in the widthwise direction at the rear side wall 203. The downstream guide portion 210 protrudes rearward from the lower end of the rear end wall 203.

The downstream guide portion 210 has a guide surface 211 facing the inner peripheral surface of the endless belt 111. The inner peripheral surface of the endless belt 111 is in sliding contact with the guide surface 211, so that the circular movement of the endless belt 111 is guided by the guide surface 211. The guide surface 211 receives the inner peripheral surface of the endless belt 111 that goes out of the nip between the nip member 133 and the pressure roller 120 in accordance with the circular movement of the endless belt 111. Thus, the inner peripheral surface of the endless belt 111 is guided toward the inner peripheral guide portion 220 by the downstream guide portion 210.

The inner peripheral guide portion 220 is provided at each widthwise end portion of the endless belt 111. As illustrated in FIG. 2, each inner peripheral guide portion 220 is positioned over a circular moving range of the endless belt 111 in the circular moving direction thereof from the upper end portion of the rear side wall 203 to the front side wall 202 via the upper side wall 201. The inner peripheral guide portion 220 protrudes outward, in a thickness direction of the endless belt 111, of the rear side wall 203, the upper side wall 201 and the front side wall 202.

Each inner peripheral guide portion 220 has a guide surface 221 facing and in contact with the inner peripheral surface of the endless belt 111 for guiding the circular movement of the endless belt 111. The inner peripheral guide portion 220 receives the inner peripheral surface of the endless belt 111 that goes out of the downstream guide portion 210 in accordance with the circular movement of the endless belt 111 so as to guide the endless belt 111 toward the nip between the nip member 113 and the pressure roller 120. Widthwise end portions of the guide surfaces 211 and 221 in the widthwise direction of the endless belt 111 are smoothly connected to each other so as to be continuous with each other.

As illustrated in FIG. 3, the restricting portion 230 is provided at a position outward of each widthwise end of the endless belt 111. The restricting portion 230 is positioned over the circular moving range of the endless belt 111 in the circular moving direction thereof from the upper portion of the guide surface 211 to the guide surface 221. The restricting portion 230 protrudes in a rib-like fashion outward, in the thickness direction of the endless belt 111, of outer sides of the guide surfaces 211, 221.

The restricting portion 230 has a flat inner side surface 231 in the widthwise direction of the endless belt 111. The flat inner surface functions as a regulating surface 231, so that a widthwise end face of the endless belt 111 is abuttable on the regulating surface 231 when the endless belt 111 is displaced in the widthwise direction during its circular movement. Thus, a position of the widthwise end of the endless belt 111 can be regulated.

The restricting portion 230 is made from resin having high slidability. A distance between the regulating surfaces 231 and 231 is slightly greater than a widthwise length of the endless belt 111. Accordingly, the endless belt 111 is abutted on the regulating surface 231 only when the endless belt 11 is displaced in the widthwise direction from a widthwise center portion of the cover member 200.

The pressure roller 120 is drivingly rotatable in a counterclockwise direction in FIG. 2 upon input of driving force from a motor (not illustrated) provided in the housing 2. The endless belt 111 is circularly moved in the clockwise direction as a follower motion. Thus, the fixing device 100 conveys the sheet S in the predetermined conveying direction, i.e., from a front to rear direction at a position between the heat unit 110 and the pressure roller 120. The pressure roller 120 is positioned below the heat unit 110 so as to nip the endless belt 111 between the pressure roller 120 and the nip member 113. The pressure roller 120 includes a shaft 121 made from metal, and a roller body 122 disposed over the shaft 121 and made from an elastic material such as a rubber.

Figure 4:
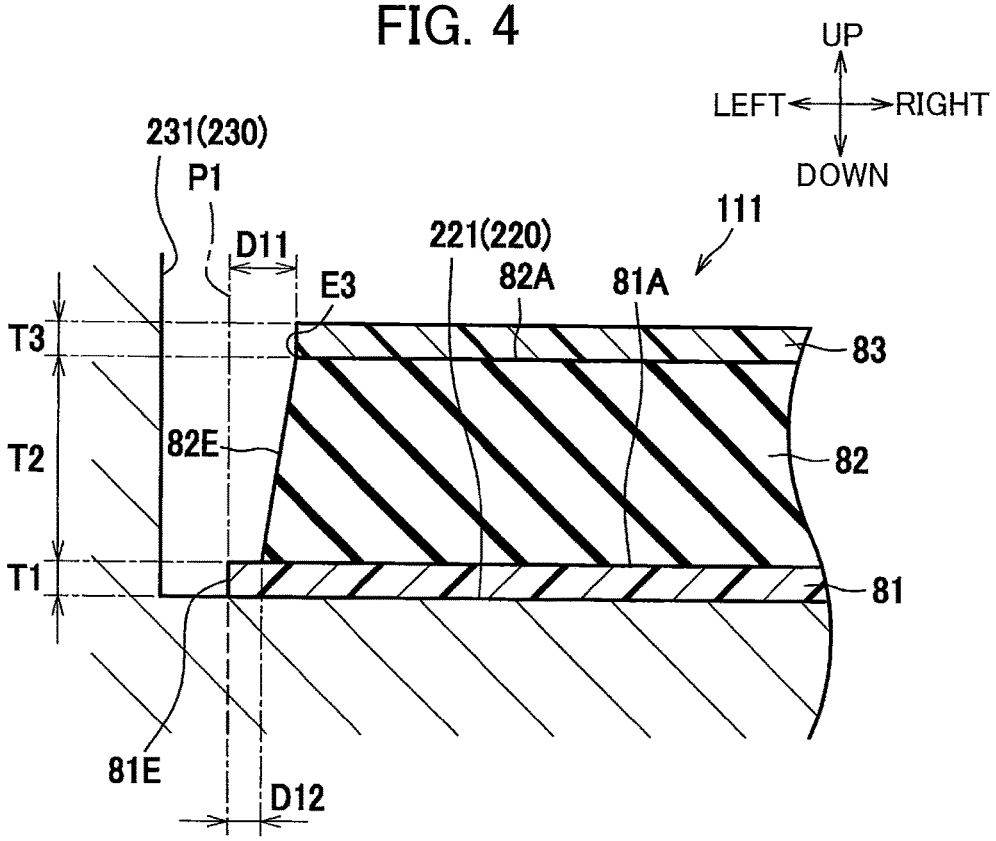
FIG. 4 is a cross-sectional view of an endless belt taken along a line IV-IV in FIG. 2.

Details of the endless belt 111 will next be described. As illustrated in FIG. 4, the endless belt 111 includes a base layer 81 as an example of a first layer, an elastic layer 82 as an example of a second layer, and a release layer 83. In this embodiment, the endless belt 111 has two widthwise end portions, both of which have the substantially same configuration. FIG. 4 shows a left-side sectional view of the endless belt 111 and the restricting portion 230 on one side, the left side, of the widthwise direction. Further, FIG. 4 shows the upper portion of the guide surface 221, taken along the line IV-IV of FIG. 2.

The base layer 81 is made from a thermally resistant resin, and constitutes a base member of the endless belt 111. The base layer 81 is formed into a tubular shape which is endless in the circumferential direction and is elongated in the leftward/rightward direction. The base layer 81 has an outer peripheral surface 81A and an end surface 81E. The outer peripheral surface 81A is an example of an upper surface. As one example, the base layer 81 is made from a polyimide resin. The base layer 81 has a thickness T1 ranging from 30 μm to 50 μm, as one example.

The elastic layer 82 is made from thermally resistant rubber and has an outer peripheral surface 82A having an end portion E3. The elastic layer 82 is formed so as to cover the outer peripheral surface 81A. As one example, the elastic layer 82 is made from silicon rubber. The elastic layer 82 has a thickness T2 larger than the thickness T1 of the base layer 81. Particularly, the elastic layer 82 has the thickness T2 of 300 μm as one example.

The elastic layer 82 has an end surface 82E. The entire end surface 82E is positioned at the position inward of (the right side in FIG. 4) the end surface 81E of the base layer 81 in the widthwise direction of the endless belt 111. In other words, the end surface 82E of the elastic layer 82 is positioned at the position which is farther from the regulating surface 231 of the restricting portion 230 than the end surface 81E of the base layer 81 from the regulating surface 231.

Accordingly, in this embodiment, the outer peripheral surface 81A of the base layer 81 has a widthwise end portion (left end portion in FIG. 4) which is exposed to an outside and is positioned outward of the end surface 82E of the elastic layer 82 in the widthwise direction, so that the widthwise end portion can be observed. In other words, the endless belt 111 has the end portion in the widthwise direction which protrudes toward the regulating surface 231, so that the end surface 82E of the elastic layer 82 is positioned farther from the regulating surface 231 than an end surface 81 of the base later 81 from the regulating surface 231.

The end surface 82E of the elastic layer 82 is a substantially flat surface. Distance between the end surface 82E and the regulating surface 231 is gradually reduced toward the outer peripheral surface 81A of the base 81. That is, the end surface 82E of the elastic layer 82 is inclined with respect to the regulating surface 231 such that the distance between the end surface 82E and the regulating surface 231 in the leftward/rightward direction is gradually reduced, as the end surface 82E comes close to the base layer 81. With this structure, the regulating surface 231 faces the end surface 82E and the end surface 81E.

A position P1 indicates a position of the end surface 81E of the base layer 81 in the widthwise direction of the endless belt 111. Regarding the end surface 82E of the elastic layer 82, a maximum length D11 between the position P1 and the end surface 82E of the elastic layer 82 in the widthwise direction is smaller than the thickness T2 of the elastic layer 82. In other words, regarding the end surface 82E of the elastic layer 82, the distance (the maximum length D11) from the position P1 to the end portion E3 is smaller than the thickness T2.

Accordingly, the projecting length D12 of the end portion of the base layer 81 from the end surface 82E of the elastic layer 82 in the widthwise direction of the endless belt 111 is smaller than the thickness T2 of the elastic layer 82. Additionally, in this embodiment, the end surface 82E of the elastic layer 82 is inclined so as to come close to the regulating surface 231, as comes inward in the radial direction of the endless belt 111. As a result, the projecting length D12 is smaller than the maximum distance D11.

The release layer 83 is made from fluoroplastic and is formed to cover the outer peripheral surface 82A of the elastic layer 82. As one example, a tubular member made from PFA (tetrafluoroethylene perfluoroalkyl vinyl ether copolymer) is covered with the elastic layer 82 which has been formed on the base layer 81, to form the release layer 83. The release layer 83 has a thickness T3 of 50 μm, as one example. The endless belt 111 has the release layer 83 as the outermost layer to prevent toner from being attached to the outer peripheral surface of the endless belt 111.

The advantages of the embodiment will be described. FIG. 5B shows an endless belt 90 as a comparative example.

The endless belt 90 according to the comparative example includes a base layer 91 having an outer peripheral surface 91A, an elastic layer 92 formed on the outer peripheral surface 91A of the base layer 91 and having an outer peripheral surface 92A, and a release layer 93 formed on the outer peripheral surface 92A. The elastic layer 92 has an end surface 92E positioned inward of the widthwise end portion of the endless belt 90 similar to an endless belt 111 according to the embodiment.

The endless belt 90 is different from the endless belt 111 according to the embodiment as follows. A distance D92 from the end surface 91E of the base layer 91 to the end surface 92E of the elastic layer 92 is larger than the thickness T92 of the elastic layer 92. Accordingly, a projecting length D92 of the projecting portion of the base layer 91 from the end surface 92E to a widthwise end of the base layer 91 in the widthwise direction is larger than the thickness T92 of the elastic layer 92.

When the endless belt 90 of the comparative example is displaced to the one side in the widthwise direction as indicated by an arrow in FIG. 5B during its circular movement, the end surface 91E of the base layer 91 is abutted to the regulating surface 231 of the restricting portion 230. Since the end portion of the base layer 91 has the projecting length D92 larger than the thickness T92 of the elastic layer 92, the end portion of the base layer 91 may be curved to be away from the guide surface 221 of the inner peripheral guide portion 220 as indicated by two-dotted chain lines in FIG. 5B, when additional force is applied to the endless belt 90 to displace the endless belt 90 to the one side in the widthwise direction. As a result of the deformation of the end portion of the base layer 91, the circular movement of the endless belt 90 may become unstable, or the end portion of the base layer 91 may be broken.

Figure 5A:
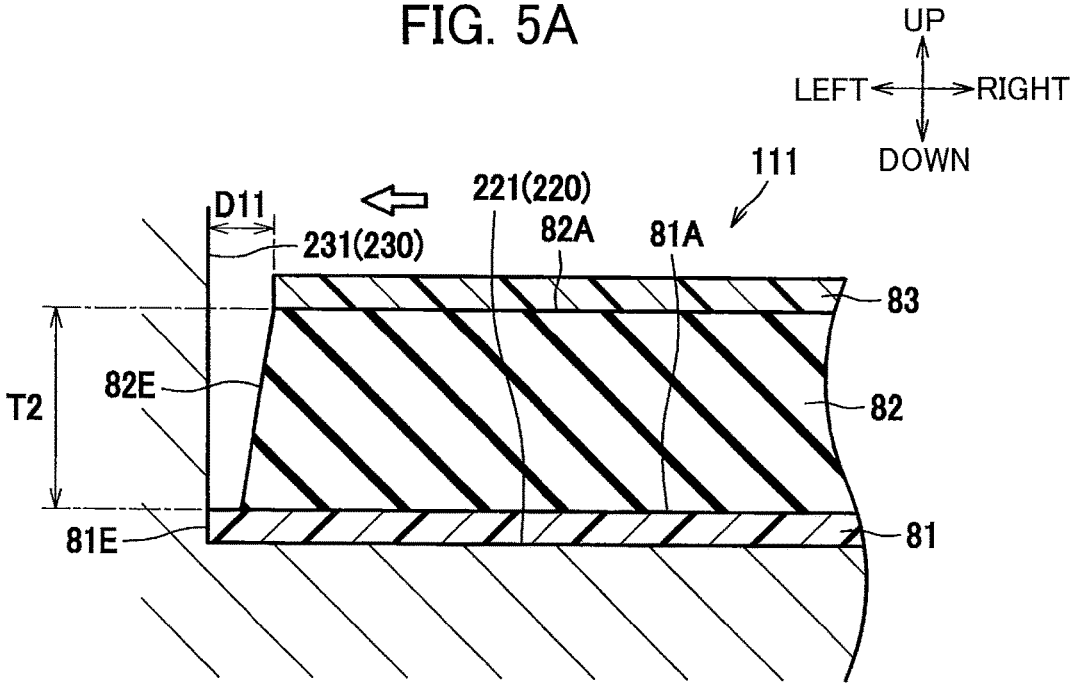
FIG. 5A is a cross-sectional view illustrating abutment of the endless belt in the fixing device against a restriction member according to the embodiment.
Figure 5B:
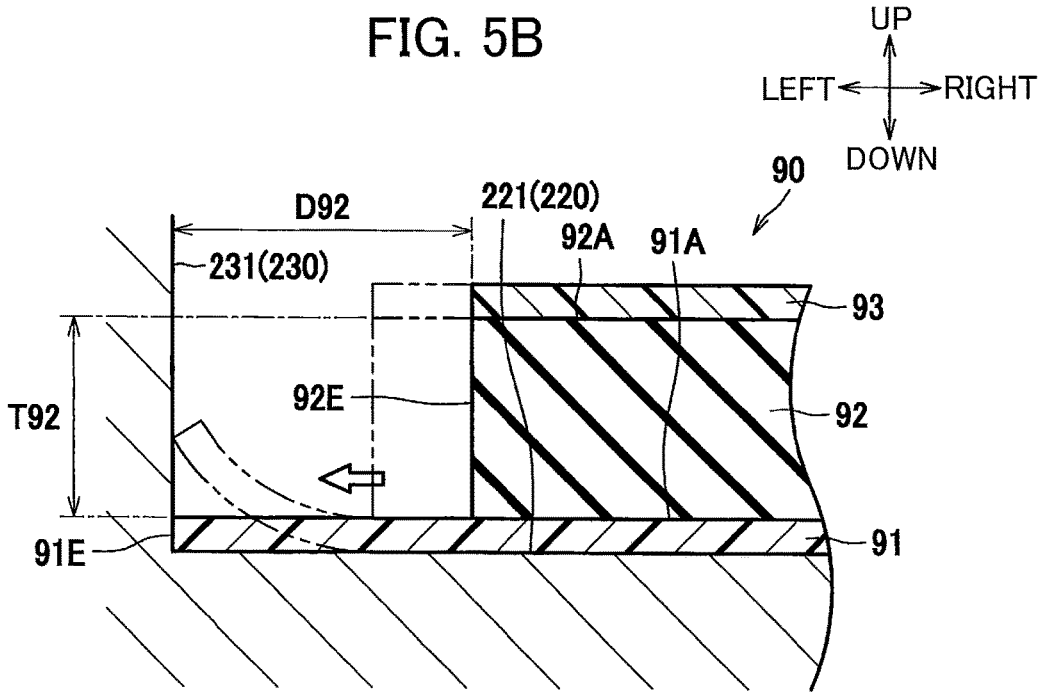
FIG. 5B is a cross-sectional view illustrating abutment of an endless belt against the restriction member according to a comparative example.

In contrast, when the endless belt 111 of this embodiment is displaced to the one side in the widthwise direction as indicated by an arrow, as illustrated in FIG. 5A, the end surface 81E of the base layer 81 is first abutted to the regulating surface 231 of the restricting portion 230. In this embodiment, since the maximum distance D11 between the end surface 81E of the base layer 81 and the end surface 82E in the widthwise direction is smaller than the thickness T2, the elastic layer 82 is provided close to the end portion of the base layer 81.

Accordingly, even if a force is applied to the endless belt 111 to be displaced to the one side in the widthwise direction, the thick elastic layer 82 can support the end portion of the base layer 81. Therefore, deformation of the base layer 81 caused by the abutment of the end surface 81E of the base layer 81 to the restricting portion 230 can be restrained. As a result, instabilities in circular movement of the endless belt 111 and the damage to the end portion of the base layer 91 can be prevented.

Further, the end surface 82E of the elastic layer 82 is positioned inward of the end surface 81E of the base layer 81 in the widthwise direction. Therefore, the end surface 82E of the elastic layer 82 is not likely to contact the regulating surface 231 of the restricting portion 230. With this structure, provision of a porous member or a grooved member as seen in the conventional technologies is not necessary. Thus, increase in torque of the endless belt 111 and wearing of the elastic layer 82 can be restrained without complex structure of the endless belt.

In this embodiment, the elastic layer 82 supports the end portion of the base layer 81 as described above, so that deformation of the base layer 81 is restricted. Consequently, contact of the end surface 82E of the elastic layer 82 with the regulating surface 231 of the restricting portion 230 can be avoided in a stabilized manner.

The outer peripheral surface 81A of the base layer 81 has a portion positioned outward of the end surface 82E of the elastic layer 82 in the widthwise direction, and the outward portion is exposed to the outside. Therefore, the end portion of the base layer 81 in the widthwise direction projects outward from the end surface 82E of the elastic layer 82 in the widthwise direction. This structure can further prevent the end surface 82E of the elastic layer 82 from being in contact with the restricting portion 230. Consequently, increase in the torque of the endless belt 111 and wearing of the elastic layer 82 can further be avoided.

Further, the end surface 82E is inclined such that the end surface 82E is positioned at the position away from the widthwise center of the elastic layer 82 as the end surface 82E of the elastic layer 82 comes close to the base layer 81. Accordingly, the end portion of the base layer 81 can be supported by the elastic layer 82 in a proper manner, while a contact between the end surface 82E of the elastic layer 82 and the restricting portion 230 can be prevented. Consequently, deformation of the base layer 81 which may be caused by abutment of the end surface 81E of the base layer 81 with the restricting portion 230 can be restricted.

Further, the thickness T2 of the elastic layer 82 is larger than the thickness T1 of the base layer 81, which ensures sufficient elasticity at the outer peripheral surface side of the endless belt 111. Accordingly, toner image can be fixed to the sheet S in a stable manner. Particularly, the color laser printer 1 according to the embodiment may transfer a plurality of colors of image to the sheet S. In this case, the plurality of colors of image can be sufficiently transferred to the sheet S between the heat unit 110 and the pressure unit 120 owing to sufficient elasticity of the endless belt 111.

Further, The above-described embodiment is particularly effective to the endless belt 111 whose base layer 81 is made from resin. Generally, the base layer 81 made from resin has lower rigidity than the base layer made from metal, so that the end portion of the base layer 81 is likely to be deformed easily. However, deformation of the base layer 81 which may be caused by the abutment of the end surface 81E of the base layer 81 against the restricting portion 230 can be prevented in the present embodiment even if the base layer 81 is made from material having low rigidity, since the end portion of the base layer 81 is supported by the elastic layer 82.

Further, the endless belt 111 has the release layer 83, so that adherence of toner to the endless belt 111 can be prevented. Further, the elastic layer 82 and the release layer 83 support the end portion of the base layer 81, so that deformation of the base layer 81 which may be caused by the abutment of the end surface 81E of the base layer 81 against the restricting portion 230 can further be prevented.

Further, the cover member 200 includes the downstream guide portion 210 and the inner peripheral guide portion 220 for guiding the circular movement of the endless belt 111, so that the shape of the endless belt 111 can be defined by the downstream guide portion 210 and the inner peripheral guide portion 220. Accordingly, the abutting position between the end surface of the endless belt 111 and the restricting portion 230 can be defined. With this structure, the restricting portion 230 can be downsized, and slidablility of the endless belt 111 with respect to the restricting portion 230 can be improved by pinpoint application of lubricant to the surface of the restricting portion 230 on which the endless belt is abutted.

Further, the restricting portion 230 protrudes radially outwardly in the radial direction of the endless belt 111 from the downstream guide portion 210 and the inner peripheral guide portion 220. This structure eliminates generation of a gap between the regulating surface 231 of the restricting portion 230 and the guide surface 211 of the downstream guide portion 210, and between the regulating surface 231 and the guide surface 221 of the inner peripheral guide portion 220. Accordingly, when the end surface 81E of the base layer 81 comes in contact with the restricting portion 230, the end portion of the base layer 81 can be supported by the downstream guide portion 210 and the inner peripheral guide portion 220 from the inside of the base layer 81. This structure prevents the end portion of the base layer 81 from being bent toward the widthwise center of the base layer 81.

Figure 6:
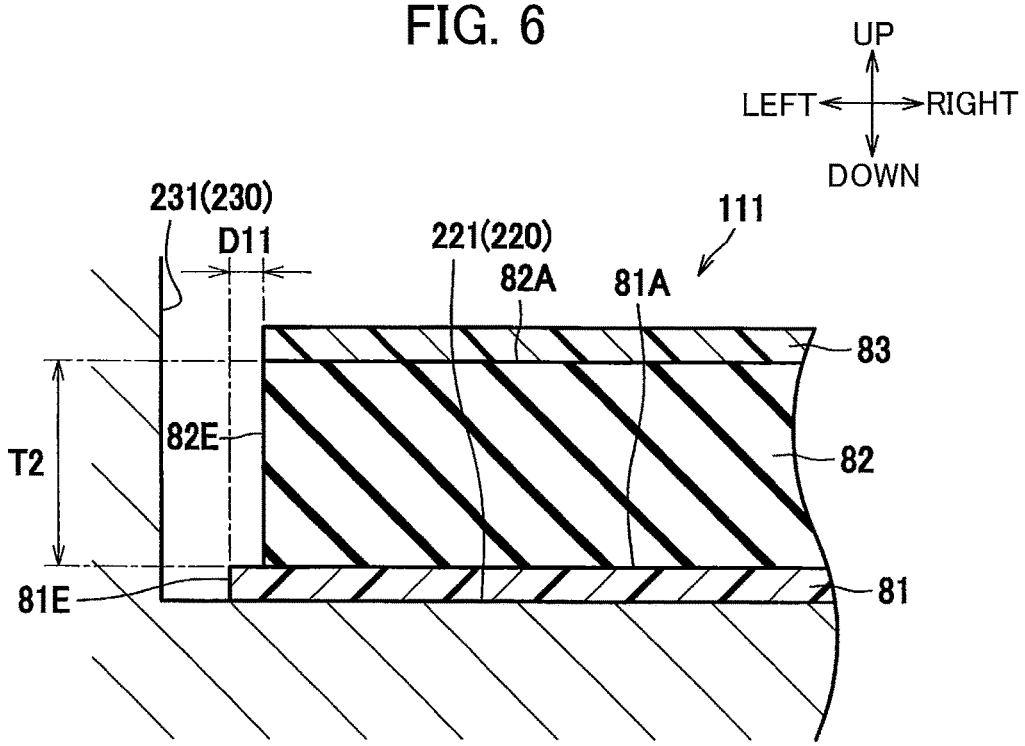
FIG. 6 is a cross-sectional view of an endless belt according to a first modification.

Various modifications are conceivable. For example, in the above-described embodiment, the end surface 82E is sloped such that the end surface 82E is positioned away from the widthwise center of the endless belt 111 as the end surface 82E of the elastic layer 82 approaches the base layer 81. As a modification as illustrated in FIG. 6, the end surface 82E of the elastic layer 82 may be perpendicular to the widthwise direction of the endless belt 111. In other words, the end surface 82E of the elastic layer 82 may be parallel to the thickness direction of the endless belt 111.

In the above-described embodiment and in the above modification illustrated in FIG. 6, the widthwise end portion of the outer peripheral surface 81A of the base layer 81 is visible or exposed to the outside, because the end portion is not covered with the elastic layer 82. As another modification illustrated in FIG. 7, the outer peripheral surface 81A of the base layer 81 cannot be observed from outside. In other words, the elastic layer 82 is formed to cover the entire outer peripheral surface 81A of the base layer 81.

Figure 7:
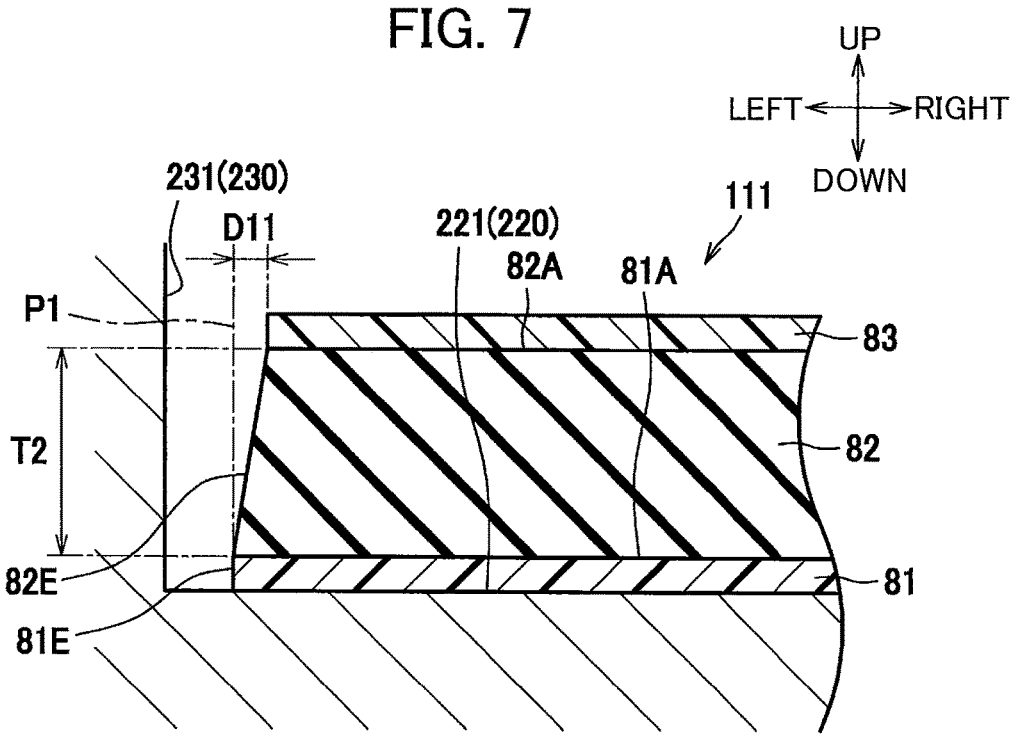
FIG. 7 is a cross-sectional view of an endless belt according to a second modification.

Further, in the second modification illustrated in FIG. 7, the end surface 82E of the elastic layer 82 is partially or entirely positioned at a position inside of the end surface 81E of the base layer 81 in the widthwise direction of the endless belt 111 so as to be away from the restricting portion 230, as the end surface 82E approaches the outer peripheral surface 82A. Regarding the end surface 82E of the elastic layer 82, a maximum distance D11 in the widthwise direction of the endless belt 111 between the position P1 indicating the position of the end surface 81E of the base layer 81 and the end surface 82E at the outer surface of the elastic layer 82 is smaller than the thickness T2.

Further, in the above-described embodiment, the end surface 82E of the elastic layer 82 is a substantially flat surface. However, the end surface of the elastic layer may be curved surface such that the end surface is positioned at a position away from the widthwise center of the elastic layer 82 as the end surface comes close to the base layer.

Further, in the above-described embodiment, the base layer 81 is made from resin. However, the base layer may be made from metal such as stainless steel. This structure prevents the base layer from frictional wearing due to sliding contact with the nip member, in comparison with a case where the base layer is made from resin. Accordingly, prolonged service lifer of the endless belt can be realized.

Further, in the above-described embodiment, the elastic layer 82 has the thickness T2 larger than the thickness T1 of the base layer 81. However, the elastic layer may have a thickness smaller than the thickness of the base layer. Alternatively, the thickness of the elastic layer may be equal to the thickness of the base layer.

Further, in the above-described embodiment, the endless belt 111 has a three-layer structure including the base layer 81, the elastic layer 82, and the release layer 83. However, the endless belt may have a double layer structure omitting the release layer. Alternatively, the endless belt may have a four layer structure including a base layer, an elastic layer, a release layer, and additional layer which is different from the above three layers.

Further, in the above-described embodiment, the cover member 200 is integral with the downstream guide portion 210, the inner peripheral guide portion 220 as examples of guide members, and the restricting portion 230 as an example of a restricting member. However, a guide member or a restricting member may be separate component from a cover member. The guide member and the restricting member may be formed separately from each other.

Further, in the above-described embodiment, the heat unit 110 includes the endless belt 111, the nip member 113, and the restricting portion 230 as the restricting member, and the pressure unit includes the pressure roller. However, the pressure unit may include an endless belt, a nip member, and a restricting member, and the heat unit may include a cylindrical roller (i.e., a heat roller) made from metal. In the latter case, the nip member of the pressure unit is positioned to nip the endless belt in cooperation with the heat unit. Further, both the heat unit and the pressure unit may include an endless belt, a nip member, and a restricting member, respectively.

Further, in the above-described embodiment, the halogen lamp 112 generating radiant heat is used as the heat source for heating the nip member 113. However, the heat source may be a ceramic heater or a carbon heater which includes a resistor generating heat. Alternatively, the nip member may be used as a heater for heating the endless belt. Further, an induction heating (IH) heater for heating an endless belt may be used, and a device for heating an endless belt and a nip member may be provided at a position outside of the endless belt rather than in the internal hollow space of the endless belt.

Further, in the above-described embodiment, the color laser printer 1 configured to print a color image on the sheet S has been described as the image forming device. However, a monochrome printer for printing a monochrome image to a sheet is also available.

While the description has been made in detail with reference to specific embodiment, it would be apparent to those skilled in the art that various changes and modifications may be made therein without departing from the spirit and scope of the above described embodiment.

What is claimed is:

1. A fixing device comprising a heat unit and a pressure unit, a toner image on a sheet being thermally fixed between the heat unit and the pressure unit, at least one of the heat unit and the pressure unit comprising:

an endless belt having a width in a widthwise direction and extending in a circumferential direction perpendicular to the widthwise direction, the endless belt comprising:

a base layer having an outer peripheral surface and a pair of widthwise end faces in the widthwise direction, the base layer defining an inner space; and an elastic layer formed on the outer peripheral surface and having a thickness and a pair of widthwise end surfaces in the widthwise direction, one of the end faces and a corresponding one of the end surfaces providing a maximum distance therebetween in the widthwise direction smaller than the thickness;

a nip member provided in the inner space and configured to nip the endless belt in cooperation with a remaining one of the heat unit and the pressure unit; the one of the widthwise end surfaces having a portion positioned inside of the corresponding one of the end faces in the widthwise direction; and a restriction member positioned outside of each of the widthwise end faces in the widthwise direction, the restriction member being configured to be abutted against the widthwise end face.

2. The fixing device according to claim 1, wherein the outer peripheral surface of the base layer has an end portion in the widthwise direction free from the elastic layer such that the end portion is exposed to an outside.

3. The fixing device according to claim 1, wherein the endless belt has a widthwise center in the widthwise direction;

wherein the widthwise end surface of the elastic layer is sloped such that the end surface is positioned at a position farther from the widthwise center in the widthwise direction as the widthwise end surface of the elastic layer approaches the base layer.

4. The fixing device according to claim 3, wherein the widthwise end surface is linearly sloped.

5. The fixing device according to claim 1, wherein the base layer has a thickness, the thickness of the elastic layer being larger than the thickness of the base layer.

6. The fixing device according to claim 1, wherein the base member is made from resin.

7. The fixing device according to claim 1, wherein the elastic layer has an outer peripheral surface, and the endless belt further comprising a release layer formed on the outer peripheral surface of the elastic layer.

8. The fixing device according to claim 1, wherein the elastic layer is made from rubber.

9. The fixing device according to claim 1, wherein the base layer has an inner peripheral surface defining the inner space; the fixing device further comprising a guide member in contact with the inner peripheral surface of the base layer to guide a circular movement of the endless belt.

10. The fixing device according to claim 9, wherein the guide member has a pair of widthwise end portions in the widthwise direction, the restriction member protruding outward in a radial direction of the endless belt from each of the widthwise end portions of the guide member.

11. The fixing device according to claim 1, wherein the heat unit comprises the endless belt, the nip member, the restriction member, and a heat source positioned in the inner space for heating the nip member.

12. The fixing device according to claim 1, wherein the pressure unit comprises a roller configured to be rotated by a driving force to circularly move the endless belt.

13. A fixing device comprising a first unit and a second unit, a toner image on a sheet being fixed between the first unit and the second unit, the first unit comprising:

an endless belt having a width in a widthwise direction and extending in a predetermined direction perpendicular to the widthwise direction, the endless belt comprising:

a first layer having a first thickness, a first end face in the widthwise direction, and an upper surface; and a second layer positioned on the upper surface of the first layer and having a second thickness and a second end face in the widthwise direction;

a nip member disposed inside a loop of the endless belt and configured to nip the endless belt in cooperation with the first unit and the second unit; and a side wall positioned outside of the second end face in the widthwise direction and extending so as to face the first end face and the second end face, wherein a maximum distance between the first end face and the second end face in the widthwise direction is smaller than the second thickness.

14. The fixing device according to claim 13, wherein the first unit includes a heat source.

15. The fixing device according to claim 13, wherein the first unit includes a roller configured to be rotated by a driving force to move the endless belt.

16. The fixing device according to claim 13, wherein the first end face extends parallel to the side wall.

17. The fixing device according to claim 13, wherein the second end face is inclined with respect to the side wall.

18. The fixing device according to claim 13, wherein the first layer further comprising an inner surface, the fixing device further comprising a guide member in contact with the inner surface of the first layer to guide a movement of the endless belt.

19. An image forming apparatus comprising a fixing device according to claim 13.

* * * * *